United States Patent [19]

Baker

[11] 4,433,885

[45] Feb. 28, 1984

[54] LAZY SUSAN ASSEMBLY HAVING A ROTATIONAL AND VERTICAL ADJUSTMENT MECHANISM

[75] Inventor: Clayton C. Baker, Belding, Mich.

[73] Assignee: Leslie Metal Arts Company, Grand Rapids, Mich.

[21] Appl. No.: 266,381

[22] Filed: May 22, 1981

[51] Int. Cl.[3] ..... A47B 81/00; A47F 3/10

[52] U.S. Cl. ..... 312/305; 312/125; 312/135; 312/238; 403/408; 403/DIG. 8

[58] Field of Search ..... 312/305, 238, 125, 135, 312/197; 211/144; 403/408, DIG. 8, 136

[56] References Cited

U.S. PATENT DOCUMENTS

| | | | |
|---|---|---|---|
| 799,233 | 9/1905 | Hubbell . | |
| 1,531,358 | 3/1925 | Thompson et al. | 312/305 |
| 2,383,068 | 8/1945 | MacLean, Jr. | 403/408 |
| 2,539,186 | 1/1951 | French | 403/136 |
| 2,673,778 | 3/1954 | Wood | 312/125 |
| 2,698,776 | 1/1955 | Stoeckl . | |
| 3,006,443 | 10/1961 | Siler | 403/408 |
| 3,127,994 | 4/1964 | Campbell . | |
| 3,160,453 | 12/1964 | Tassell | 312/238 |
| 3,172,712 | 3/1965 | Allen | 312/305 |
| 3,266,857 | 8/1966 | Anderson . | |
| 3,281,197 | 10/1966 | Anderson . | |
| 3,982,800 | 9/1976 | Gorton et al. | 312/305 |
| 4,181,037 | 1/1980 | Boon et al. . | |

*Primary Examiner*—Victor N. Sakran

*Attorney, Agent, or Firm*—Varnum, Riddering, Schmidt & Howlett

[57] ABSTRACT

A lazy susan (24) including a shaft (30) supported for rotation about a vertical axis within an L-shaped cabinet (10) is provided with a rotary catch mechanism (40) which maintains the shaft at a selected rotary position relative to the cabinet (10). The catch mechanism (40) includes a cam (44) and follower (42) which maintain the shaft (30) in the selected rotary position. The follower (42) is provided with means for adjusting its angular position so as to change the orientation of the follower (42) with respect to the cabinet (10) and thus adjust the position of the shaft (30) and attached door (22*a–b*) relative to the cabinet (10). The follower (42) is adjusted by an eccentric (70) mounted for rotation with the follower (42) so that upon rotation of the eccentric (70), the follower (42) is likewise rotated to change its position relative to the cabinet (10). The vertical position of the lazy susan (24) within the cabinet (10) can also be adjusted with a shaft height adjustment mechanism (80) which includes a wedge (82) disposed beneath the shaft (30). The wedge (82) displaces the shaft (30) vertically along its axis upon movement of the wedge (82) either toward or away from the shaft (30).

26 Claims, 6 Drawing Figures

LAZY SUSAN ASSEMBLY HAVING A ROTATIONAL AND VERTICAL ADJUSTMENT MECHANISM

DESCRIPTION

Technical Field

The invention relates to a rotatable shelf assembly, commonly known as a lazy susan, which includes alignment mechanisms for adjusting the position of the cabinet doors relative to the cabinet frame.

Background Art

Rotatable lazy susan assemblies have long been used in in corner kitchen cabinets. Such assemblies have become popular as they allow for access to otherwise inaccessible areas of the cabinets. One of the problems encountered with the prior known assemblies is the difficulty of aligning the doors relative to the cabinet frame which houses the assembly. In order to present a pleasing appearance, it is desirable that the doors be properly aligned within the cabinet and flush with the front face thereof or extending slightly therefrom. A common type of catch mechanism used to maintain the cabinet in a closed position includes a cam rotatable with a shaft and a follower which has a tooth or pawl which fits into a notch in the cam. Various adjustment devices have been provided for such catch mechanisms in order to align the door panels with the cabinet.

One alignment mechanism for a lazy susan is shown in the Boon U.S. Pat. No. 4,181,037, issued Jan. 1, 1980. The Boon patent discloses a mechanism wherein a worm and bevel gear arrangement is used to vertically align the doors of a lazy susan within a cabinet. Horizontal misalignment of the doors is corrected by rotating the entire alignment mechanism about its vertical axis.

The Campbell, U.S. Pat. No. 3,127,994, issued Apr. 7, 1964, discloses another form of a rotatable shelf assembly for use in corner cabinets including a cam and follower catch as described above. The shaft with which the shelf rotates includes a telescoping member which allows for vertical adjustment of the shaft relative to the cabinet. Rotational alignment of the shelf assembly is accomplished by moving a leaf spring which supports the follower within a bracket and further by moving the bracket relative to the cam. Adjusting the pressure of the follower against the cam allows for easy rotation of the shaft and attached shelves.

The Anderson, U.S. Pat. No. 3,281,197, issued Oct. 25, 1966, includes another form of a corner shelf assembly which includes an annular cam fixed to the shelf frame and a roller journalled on a collar supported on a cabinet. The roller is spring biased so as to bear against the cam surface. The closed position of the cabinet can be adjusted by rotating a screw into the collar so as to bend the support for the roller. The roller fits into a notch in the cam when the door is in the closed position.

The Anderson U.S. Pat. No. 3,266,857, issued Aug. 16, 1966, discloses a shelf structure which includes an adjustment mechanism for vertically adjusting door panels within a cabinet opening. In the structure shown in the Anderson '857 patent rotation of a pivot pin which extends through a lower shaft bearing causes the shaft to shift vertically with respect to the cabinet. In this regard, the lower end of the threaded nut pin is seated in a bearing cup, so that rotation of the pin causes the pivot assembly secured with the shelf to shift upwardly or downwardly along the threaded portion of the pin.

Finally, the Stoeckl patent, U.S. Pat. No. 2,698,776, issued Jan. 4, 1955, discloses a corner cabinet including a lever-like follower which includes a roller which bears against a cam secured with the shelf structure. The cam position is adjusted by rotating a screw which changes the orientation of a notch in the cam relative to the cabinet.

As can be seen, various mechanisms for aligning a shelf structure within a cabinet have been used with cam and follower-type rotary catch devices.

DISCLOSURE OF THE INVENTION

In accordance with the invention, a rotary catch mechanism for a shaft which is supported by bearings for rotation about a vertical axis includes a cam which is rotatable with the shaft and a follower which has a tooth selectively received in the cam so as to maintain the shaft in a desired rotary position. The position of the follower is adjustable with respect to the shaft and adjustment of the selected rotary position of the shaft is effected by changing the follower position. The follower is pivotably mounted to the housing and the mounting includes means for pivoting the follower about an eccentric axis. Accordingly, when the follower is pivoted about the eccentric axis, the angular orientation of the follower within the housing is changed which in turn adjusts the desired rotary position of the shaft by changing the position of the tooth relative to the housing.

The follower is mounted to the housing by a pin. An annular space is provided adjacent the portion of the follower through which the pin extends. A cylindrical member is mounted on the pin for rotation within the annular space. The pin and follower are mounted along the pin on an eccentric axis with respect to their center lines so as to provide for eccentric rotation of the follower when the cylindrical member is rotated.

The follower is preferably in the form of a lever arm which is pivotably mounted by the pin. The tooth on the follower bears against the cam surface during rotation of the cam. In order to maintain the tooth in contact with the cam surface, a spring is provided so as to bias the follower against the cam.

The shaft can also be provided with a vertical adjustment mechanism so as to allow for vertical as well as rotational positioning of the shaft with respect to the housing.

One typical use of the above-described rotary catch mechanism is in a corner cabinet lazy susan. The lazy susan comprises a shaft which is supported in a housing for rotation wherein the shaft carries at least one shelf which allows for storage of various items. Secured to the shelf and rotatable therewith are door panels which conform to an opening in an L-shaped front panel in the corner cabinet. The lazy susan structure is provided with the above-described alignment mechanisms to adjust the position of the doors relative to the cabinet and the L-shaped opening so that when the cabinet is closed, the doors are aligned with the cabinet.

The vertical height adjustment mechanism for the shaft includes a wedge disposed beneath the shaft wherein the wedge is displaceable towards and away from the shaft. The bottom portion of the shaft is provided with a surface complementary to the wedge so that movement of the wedge is transmitted to the shaft so as to allow for vertical adjustment thereof. The shaft height adjustment mechanism is typically used in the above-described lazy susan structure.

The wedge is an inclined member which is slidable along its base. The wedge is displaced by a threaded member which is mounted on a stationary bracket so that rotation of the thread causes the wedge to move towards or away from the shaft and thus adjust the vertical position of the shaft and attached door panels relative to the lazy susan housing. The height adjustment mechanism includes a means for limiting displacement which would prevent the shaft from being displaced a distance which would interfere with a top bearing which supports the shaft for rotation. The limiting mechanism includes a stop member which bears against the wedge when the wedge is displaced in contact therewith.

BRIEF DESCRIPTION OF THE DRAWINGS

The invention will now be described with reference to the accompanying drawings in which.

BEST MODE FOR CARRYING OUT THE INVENTION

Figure 1:
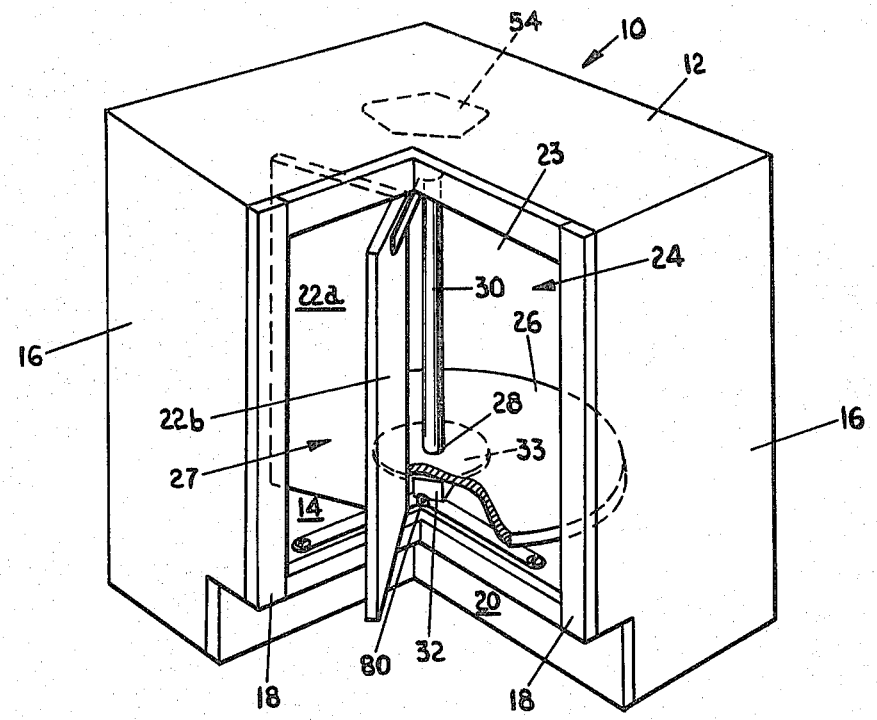
FIG. 1 is a perspective view of a cabinet unit including a rotary alignment mechanism and a shaft height adjustment mechanism in accordance with the invention.

Referring to FIG. 1, a corner cabinet 10, typically a kitchen corner cabinet, has a top wall 12, a bottom wall 14, side walls 16, front walls 18 and back walls (not shown). The front walls 18 of the cabinet provide an L-shaped configuration so as to allow for mounting in a corner location. Such a cabinet 10 can be positioned above or below a kitchen counter-top and serves to store items anywhere within the cabinet 10, including the extreme rear corners of the cabinet 10, which are usually inaccessible. If the cabinet 10 is placed below the countertop, a toe recess 20 can be provided at the bottom of the cabinet 10. Two vertical door panels 22*a* and 22*b* disposed at right angles to each other cover an opening 23 in the front walls 18 of the cabinet 10. The door panels 22*a* and 22*b* are aligned flush with or extending slightly from the front walls 18 of the cabinet 10 when the cabinet 10 is closed. The door panels 22*a* and 22*b* which cover the opening 23 are secured to a rotatable shelf assembly 24, to be described below, and are releasably held in a closed position by a rotary catch mechanism 40 in accordance with the invention.

Within the cabinet 10 is the rotatable shelf assembly 24, referred to as a lazy susan, which is mounted between top and bottom walls 12 and 14. Door panels 22*a* and 22*b* are secured to and rotatable with the lazy susan 24. The lazy susan 24 includes at least one shelf 26 having a pie-slice cut-out 27 which corresponds to the corner mounting of the cabinet. A hole 28 provided at the center of the shelf 26 receives a central shaft 30. The vertical door panels 22*a* and 22*b* are mounted to the edges of the shelves 26 bordering the pie-slice cut-out 27. The shelves 26 are typically made of wood, metal or plastic.

Figure 2:
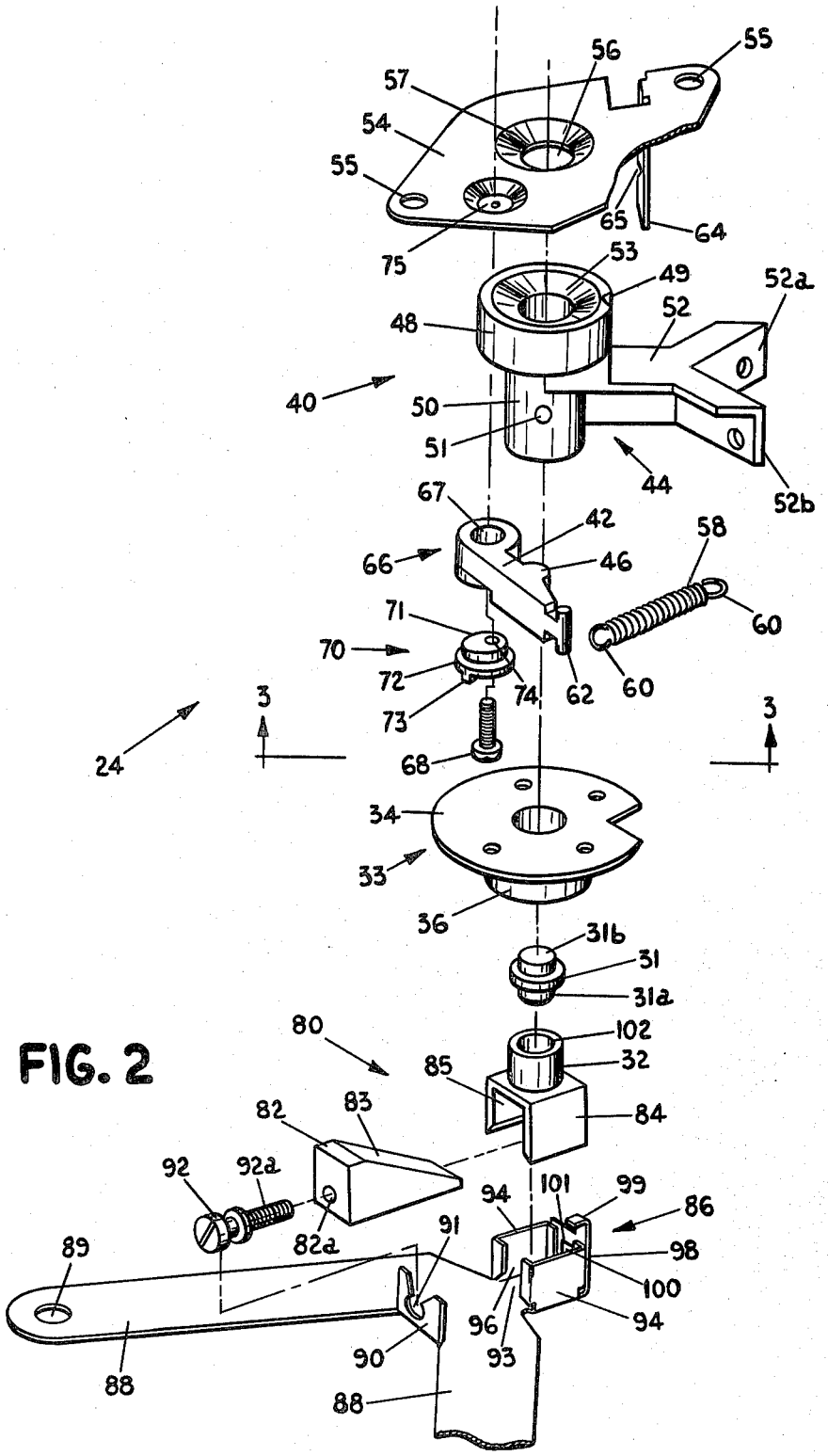
FIG. 2 is an exploded view of the invention shown in FIG. 1.

The shelf 26 is mounted to the shaft 30 by a hub 33. As seen in FIG. 2, the hub 33 includes a flat mounting plate 34 which supports the shelf 26 and a cylindrical section 36 integral with the plate 34 and depending therefrom. The plate 34 is mounted to the bottom of the shelf 26 by screws, while the cylindrical section 36 is secured to the shaft 30 by a conventional fastener, such as a set screw or wing nut. The hub 33 can be made out of plastic or metal.

Referring to FIG. 2, the rotational shelf assembly 24 includes the shaft 30 rotatably mounted between the rotary alignment mechanism 40 and a height adjustment mechanism 80 described in detail below. The shaft 30 fits over a top cylindrical portion 31*b* of a bottom bearing 31. A bottom cylindrical portion 31*a* of the bearing 31 is received within a round hole 102 within a shaft socket 32 located above the shaft height adjustment mechanism 80. The bottom bearing 31 serves as an adapter between the shaft 30 and shaft socket 32 and provides for rotation of the shaft 30. The top of the shaft 30 is received within a frusto-conical portion 57 of a mounting plate 54, which functions as a bearing for the shaft 30.

Figure 3:
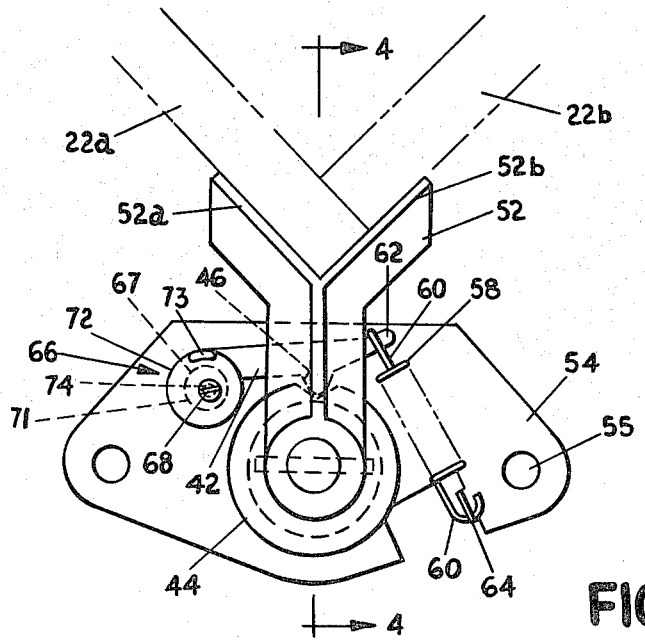
FIG. 3 is a view of the rotary alignment taken along line 3—3 of FIG. 2 showing the cabinet in the closed position.
Figure 4:
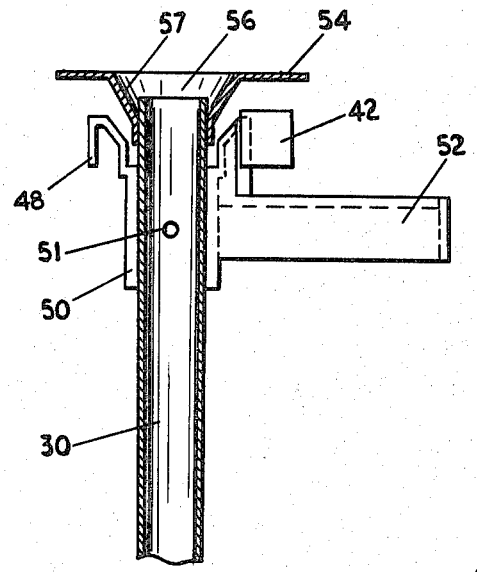
FIG. 4 is a sectional view taken along line 4—4 of FIG. 3.

The rotary catch mechanism 40, depicted in FIG. 2 and more particularly in FIGS. 3 and 4, serves as a means for stopping and aligning the rotary position of the door panels 22*a* and 22*b* with respect to the cabinet 10. The catch mechanism 40 positioned at the top part of the shaft 30 and the cabinet 10 includes a spring-loaded follower 42 which bears against a cam 44 mounted with the shaft for rotation therewith.

The rotatable cam 44 includes a cam surface 48, a cylindrical sleeve 50 which secures the cam 44 to the shaft 30, and a Y-shaped bracket 52 having legs 52*a* and 52*b* extending outwardly from the sleeve 50 which serve to fasten the cam 44 to the door panels 22*a* and 22*b*. The cylindrical sleeve 50 is coaxial with and positioned below the cam surface 48. The cylindrical sleeve 50 receives the shaft 30 and is secured thereto with a pin or fastener which extends through a hole 51 in the cylindrical sleeve 50 and the shaft 30. The Y-shaped bracket 52 is integral with and extends outwardly from the sleeve 50 and serves to connect the door panels 22*a* and 22*b* of the cabinet 10 with the rotary catch mechanism 40 of the rotatable shelf assembly 24. The cam surface 48 has a detent 49 in the periphery thereof.

A mounting plate 54 secured to the top wall 12 of the cabinet 10 with conventional fasteners inserted through holes 55 provides a support for the top of the shaft. The holes 55 are oversized so that the mounting plate 54 can be adjusted when the fasteners and accompanying washers are loosened. The plate 54 includes a frusto-conical portion 57 which converges towards the cabinet interior. The frusto-conical portion 57 forms a hole 56 which receives and provides a bearing for the top of the shaft 30. The top surface 53 of the cam 44 is dish-shaped and thus has a configuration approximately corresponding to the frusto-conical portion 57 of the plate 54. The plate 54 is preferably a sheet metal stamping.

The spring-loaded follower 42 of the rotary catch mechanism 40 is in the form of a pivotably mounted lever arm on which is disposed a tooth 46. The tooth 46 fits in the detent 49 on the cam surface 48 when the tooth 46 is adjacent the detent 49. The follower 42 is biased against the cam surface 48 of the cam 44 by a coil spring 58. The coil spring 58 has connecting loops 60 at each end. One loop 60 is connected to a tab 62 on the follower 42 and the other loop 60 is connected to a flange 64 on the mounting plate 54. The flange 64 extends downwardly from the mounting plate 54 and includes a notch 65 which receives the loop 60 of the spring 58. The flange 64 is usually stamped out from the body of the plate 54 during manufacturing. Thus, when the shaft 30 and attached cam 44 are rotated, the tooth 46 of the follower 42 bears against the cam surface 48 of the cam 44, due to the force provided by the spring 58. When the tooth 46 is received in the detent 49, the door panels 22*a* and 22*b* are aligned in a closed or stop position relative to the cabinet 10, the panels 22*a* and 22*b* being properly aligned with the front walls 18. When the tooth 46 is forced out from the indentation 49 upon rotation of the shelf structure, the cam 44 rotates freely with the shaft 30.

The follower 42 is in the form of a lever arm and is pivotably mounted at one end 66 to the mounting plate 54. End 66 of the follower 42 includes a bore 67 through which is inserted a screw 68. The screw 68 is threadably received in a hole 75 located in a depression in the mounting plate 54 which spaces the follower 42 from the top wall 12 of the cabinet and adjacent the cam 44. The screw 68 serves as a pin means to pivotably mount the follower 42 to the mounting plate 54 which is secured to the top wall 12 of the cabinet 10.

In order to provide a device for changing the position of the follower 42 which in turn adjusts the closed position of the door panels 22*a–b* relative to the cabinet 10, an eccentric member 70 is mounted for rotation within end 66 of the follower 42. In this regard, the bore 67 within end 66 of the follower 42 receives the eccentric member 70 so that both the eccentric member 70 and the follower 42 are mounted along a common axis of rotation, the screw 68. The eccentric member 70 includes a cylindrical portion 71 which is received within the bore 67 and a flat base section 72 of greater diameter than the cylindrical portion 71. A bore 74 extends along the axis of rotation of the eccentric member 70 with the core 74 being positioned off center from the central axis of the members. The eccentric mounting of the follower 42 and eccentric member 70 cause the follower 42 to be rotated about the screw 68 when the eccentric member 70 is rotated. In this regard, the eccentric member 70 bears against the inner wall of the bore 67 during rotation of member 70, thus causing the follower 42 to deflect angularly with respect to its pivot axis. In this way, the angular position of the follower 42 and the tooth 46 thereon is changed relative to the cabinet 10, thus changing the closed position of the doors 22*a–b* which is set by the position of the tooth 46. In order to facilitate rotation of the eccentric member 70, a tab 73 extends from the base portion 72 so as to provide a grip for rotating the eccentric 70.

The above-described mechanism provides a means for adjusting the rotational position of the shelf structure with respect to the cabinet 10. In particular, the alignment of the door panels 22*a–b* within the cabinet 10 can be changed by use of the rotary alignment mechanism 40. In order to adjust the position of the doors 22*a–b* relative to the cabinet 10, the eccentric member 70 is rotated about its axis. Rotation of the eccentric member 70, due to its off center mounting, causes a likewise rotation of the follower 42 about its pivot axis. Changing of the position of the follower 42 with respect to the cabinet 10 thus defines a new closed position since the point at which the detent 49 in the cam surface 48 receives the tooth 46 on the follower 42 is determined by the position of the follower 42.

The alignment is typically accomplished by opening the cabinet and loosening the screw 68, then rotating the eccentric member 70 which causes a like change in the position of the tooth 46 on the follower 42 relative to its former position. The screw 68 is tightened when the eccentric member 70 is in proper adjusted position. The cabinet 10 is then closed in order to see if the doors 22*a–b* are now aligned with the cabinet 10. If further adjustment is necessary, the process is repeated until the door panels 22*a–b* are properly aligned with the cabinet 10. The above-described alignment mechanism 40 is relatively simple to use and does not require any adjustment of the tension provided by the coil spring 58. Further, no movement of the follower 42 except about its axis of rotation takes place. Thus, relatively little wear and tear on the parts of the alignment mechanism 40 is experienced since the only movement is rotational.

Both the cam 44 and the follower 42 including the eccentric member 70 are preferably made of plastic, although they can be made of metal. The mounting plate 54 is typically a meal stamping, although it can be made of plastic as well.

Figure 5:
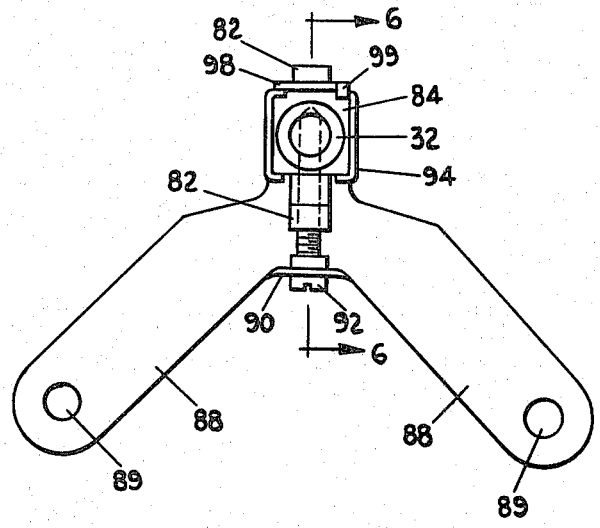
FIG. 5 is a top view of the shaft height adjustment mechanism in accordance with the invention.
Figure 6:
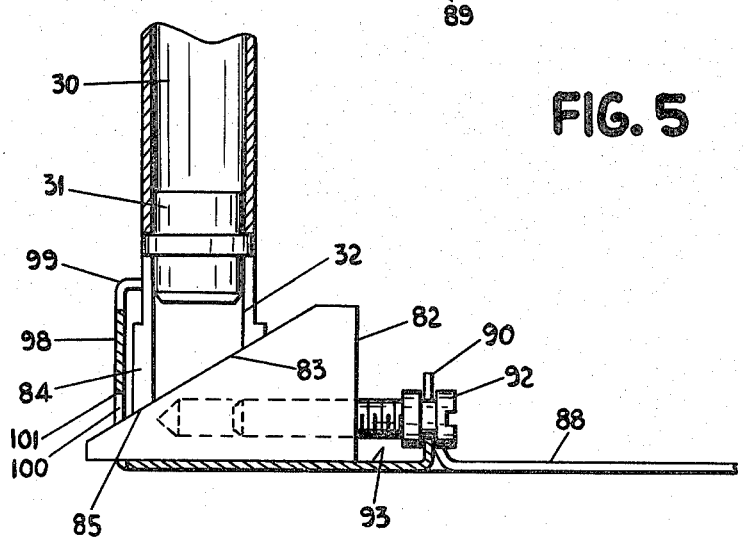
FIG. 6 is a sectional view of the shaft adjustment mechanism taken along line 6—6 of FIG. 5.

The shaft height adjustment mechanism 80 depicted in FIGS. 2, 5 and 6 serves as a means for adjusting the vertical position of the shaft 30 and attached door panels 22*a–b* relative to the cabinet 10. The height adjustment mechanism 80 is positioned below the shaft 30. The adjustment mechanism 80 includes a wedge 82 slidable over a base portion 93 and within a bearing support 84 secured with the shaft 30. The wedge 82 has an inclined surface 83. The bearing support 84 provides a lower bearing for the shaft 30 and is secured to the cabinet 10 by a bracket 86. The bracket 86 prevents radial movement of the shaft 30 and bearing support 84.

The bracket 86 may be secured to or integral with a lower mounting bracket 88 for the shelf structure. The lower mounting bracket 88 has a generally L-shaped configuration and is secured to the bottom wall 14 of the cabinet 10 by inserting conventional fasteners into holes 89. As with holes 55 of the mounting plate 54, holes 89 are oversized so that the positioning of the bracket 88 can be adjusted when the fasteners and accompanying washers are loosened. The bracket 86 includes a base portion 93, two opposing side walls 94, each of which has a generally shallow U-shaped configuration, and a rear wall 98. The walls of the bracket 86 thus provide a partially enclosed structure in which is received the bearing support 84. The front portion of the bracket 86 is open between the legs of the U-shaped side walls 94 so as to receive the sliding wedge 82. The rear wall 98 of the bracket 86 has a rectangular hole 100 through which the front end of the wedge 82 is able to extend. A top edge 101 of the hole 100 serves as a stop member for limiting forward movement of the wedge 82 and, therefore, limiting vertical displacement of the bearing support 84, as further described below. Additionally, an integral flange 99 extends upwardly and inwardly from the rear wall 98 to retain the support 84 within the bracket 86 during shipping, handling and assembly.

The bearing support 84 has a generally cube-like configuration. The support 84 includes an interior inclined surface 85. The incline of surface 85 corresponds to the incline 83 on the wedge 82. Thus, movement of the wedge 82 causes a corresponding movement of support 84 due to the sliding motion between the two inclines 83 and 85. Since the support 84 is mounted to the bottom of the shaft 30 by means of a bearing 31 and a shaft socket 32, vertical movement of the support 84 causes the shaft 30, likewise, to move vertically.

In order to effect vertical adjustment, the wedge 82 is either displaced towards or away from the shaft 30. In order to displace the wedge 82, a threaded member 92 is mounted to a screw plate 90 which may be secured to the lower mounting bracket 88. The plate 90 is a generally-upstanding flange which includes a keyhole-shaped cut-out 91 in which the threaded member 92 is rotatably mounted. The threaded end 92*a* of the member 92 is received in a corresponding threaded bore 82*a* in the wedge 82. Thus, threaded member 92 is held stationary with respect to the plate 90 and rotation of the threaded member 92 causes the wedge 82 to move inwardly or outwardly along the thread.

Accordingly, when the threaded member 92 is turned counterclockwise, the wedge 82 moves forwardly toward the bearing support 84 so that the inclined surface 83 on the wedge 82 slides under the corresponding incline 85 in the support 84. As the wedge 82 is displaced into the support 84, the inclined surfaces 83 and 85 cause the shaft 30 to be raised in a vertical direction. As the inclined surface 83 is further displaced toward the bearing support 84, the wedge 82 extends within and through the hole 100 of the rear wall 98 of the bracket 86 until surface 83 abuts the top edge 101, thereby limiting forward movement of the wedge 82, as well as vertical movement of the support 84 and shaft 30. When the threaded member 92 is rotated in a clockwise direction, the wedge 82 is withdrawn from the bearing support 84, thus allowing the shaft 30 to drop downwardly until the bottom of the bearing support 84 rests on the base portion 93 of the bracket 86.

Thus, the top edge 101 of the hole 100 provides a stop against which the inclined surface 83 of the wedge 82 contacts. Additionally, the height to which the support 84 and shaft 30 can be raised is fixed by the height of the top edge 101 of the hole 100 and/or the angle of the inclined surface 83 on the wedge 82.

The lower mounting bracket 88, screw plate 90 and bracket 86 are preferably made of a metallic material, but may be made of plastic. The support 84, wedge 82 and shaft socket 32 are preferably plastic, but may be metallic.

The foregoing description and drawings are merely illustrative of the invention and are not intended to limit the invention to the above-described embodiments. Variations and changes which may be obvious to one skilled in the art may be made without departing from the scope and spirit of the invention which is defined in the appended claims.

The embodiments of an invention in which an exclusive property or privilege is claimed are defined as follows:

1. In a rotary catch mechanism for a shaft supported in a housing by bearings for rotation about a vertical axis, said mechanism including:

a cam having a notch in a peripheral surface thereof and mounted for rotation with said shaft;

a follower including means selectively received in said notch for maintaining said shaft in a selected at rest rotary position relative to said housing;

the position of said follower being adjustable with respect to said housing; and means for adjusting the selected at-rest rotary position of said shaft relative to said housing;

the improvement in said shaft-adjusting means which comprises:

mounting means for pivotably mounting said follower to said housing for pivoting movement about an eccentric axis;

wherein pivoting of said follower about said eccentric axis adjusts the angular position of the follower with respect to said housing, thereby changing the selected at-rest rotary position of said shaft relative to the housing.

2. The rotary alignment mechanism of claim 1 wherein said mounting means includes pin means for pivotably mounting said follower, said pin means being secured to said housing.

3. The rotary alignment mechanism of claim 2 wherein said follower includes an annular space adjacent said pin means and said means for pivoting said follower includes a cylindrical member rotatable within said annular space, said cylindrical member and said follower being eccentrically mounted on said pin relative to a center line of said member and said follower.

4. The rotary alignment mechanism of claim 3 wherein said follower is a lever arm.

5. The rotary alignment mechanism of claim 4 further including spring means for biasing said means received in said notch against a peripheral surface of said cam during rotation thereof.

6. The rotary alignment mechanism of claim 5 wherein said means received in said notch is a tooth disposed on said follower.

7. The rotary alignment mechanism of claim 6 wherein said spring means is a coil spring mounted between said follower and said housing.

8. The rotary alignment mechanism of claim 1 further including means for adjusting the vertical position of said shaft relative to said housing.

9. The rotary alignment mechanism of claim 8 wherein said means for adjusting the vertical shaft position includes wedge means disposed beneath said shaft for displacing said shaft along said vertical axis.

10. The rotary alignment mechanism of claim 1 wherein said cam includes a dish-shaped top surface which allows for movement thereof relative to said bearings.

11. In a lazy susan including:

a shaft supported by bearing means for rotation about a vertical axis in a cabinet, said cabinet having a generally L-shaped front panel with a central opening therein;

at least one shelf secured to said shaft for rotation therewith;

door panels secured to said shelf and conforming to the opening in said L-shaped front panel;

a rotational alignment mechanism for maintaining the shaft in a selected at-rest rotary position relative to said L-shaped front panel;

said alignment mechanism including:

a cam rotatable with the shaft and having a notch in a peripheral surface thereof;

a follower including means selectively received in said notch for maintaining said shaft in the selected at-rest rotary position relative to said housing;

the position of said follower being adjustable with respect to said housing; and means for adjusting the selected at-rest rotary position of said shaft relative to said housing;

the improvement in said shaft-adjusting means which comprises:

mounting means for pivotably mounting said follower to said housing for pivoting movement about an eccentric axis;

wherein pivoting of said follower about said eccentric axis adjusts the angular position of the follower with respect to said housing, thereby changing the selected at-rest rotary position of said shaft relative to the housing.

12. The lazy susan mechanism of claim 11 wherein said mounting means includes pin means for pivotably mounting said follower, said pin means being secured to said housing.

13. The lazy susan mechanism of claim 12 wherein said follower includes an annular space adjacent said pin means and said means for pivoting said follower includes a cylindrical member rotatable within said annular space, said cylindrical member and said follower being eccentrically mounted on said pin relative to the center line of said member and said follower.

14. The lazy susan mechanism of claim 13 wherein said follower is a lever arm.

15. The lazy susan mechanism of claim 14 wherein said means received in said notch is a tooth disposed on said follower.

16. The lazy susan mechanism of claim 15 further including spring means for biasing said means received in said notch against a peripheral surface of said cam during rotation thereof.

17. The lazy susan mechanism of claim 16 wherein said spring means is a coil spring mounted between said follower and said housing.

18. The lazy susan alignment mechanism of claim 11 further including means for adjusting the vertical position of said shaft relative to said housing.

19. The lazy susan mechanism of claim 18 wherein said means for adjusting the vertical shaft position includes wedge means disposed beneath said shaft for displacing said shaft along said vertical axis.

20. The lazy susan mechanism of claim 11 wherein said cam includes a dish-shaped top surface which allow for movement thereof relative to said bearings.

21. In a lazy susan including a shelf structure rotatably mounted to a shaft supported by bearing means for rotation about a vertical axis in a cabinet, said cabinet having a generally L-shaped front panel with a central opening therein, door panels mounted to said shelf structure for rotation therewith, said doors panels being aligned within said central opening and about flush with said front panel when said shelf structure is in a closed position, and means for adjusting the vertical position of said shelf structure within said central opening relative to said cabinet;

the improvement which comprises said means for adjusting the vertical position including wedge means disposed beneath said shaft for displacing said shaft along a vertical axis, said wedge means being mounted for displacement towards and away from said shaft;

means on said shaft in sliding contact with said wedge means for transmitting movement of said wedge means to said shaft; and means for displacing said wedge means;

wherein displacement of said wedge means causes said shaft to move along said vertical axis so as to align said door panels within said central opening of said cabinet front panel.

22. The lazy susan of claim 21 wherein said wedge means is an inclined member slidable along a base portion thereof and said means for displacing said wedge means includes a threaded member mounted in a stationary plate for rotation therein so that said threaded member bears against said wedge means to effect displacement thereof.

23. The lazy susan of claim 22 wherein said means on said shaft includes an inclined portion complementary to said inclined member.

24. The lazy susan of claim 23 wherein said means on said shaft includes a bearing member for rotatably mounting said shaft.

25. The lazy susan of claim 21 further comprising means for limiting vertical displacement of said shaft.

26. The lazy susan of claim 25 wherein said means for limiting vertical displacement comprises a stop member which bears against said wedge means, thereby limiting displacement of said wedge means towards said shaft and limiting vertical displacement of said shaft.

* * * * *